US005798478A

United States Patent [19]

Beal

[11] Patent Number: 5,798,478

[45] Date of Patent: Aug. 25, 1998

[54] AMMUNITION PROJECTILE HAVING ENHANCED FLIGHT CHARACTERISTICS

[75] Inventor: Harold F. Beal, Rockford, Tenn.

[73] Assignee: Cove Corporation, Knoxville, Tenn.

[21] Appl. No.: 834,377

[22] Filed: Apr. 16, 1997

[51] Int. Cl.[6] ..... F42B 10/32

[52] U.S. Cl. ..... 102/501; 102/490; 244/3.1; 244/3.3

[58] Field of Search ..... 102/430, 439, 102/473, 490, 498, 501–503, 506–511, 513–518, 529; 244/3.1, 3.24, 3.3

[56] References Cited

U.S. PATENT DOCUMENTS

| | | | |
|---|---|---|---|
| 753,504 | 3/1904 | Meigs et al. . | |
| 3,809,339 | 5/1974 | Sieling et al. | 244/3.3 |
| 4,517,897 | 5/1985 | Kneubühl | 102/439 |
| 4,813,635 | 3/1989 | Paterson et al. | 244/3.1 |
| 4,895,077 | 1/1990 | Miethlich et al. | 102/517 |
| 5,275,108 | 1/1994 | Chernicky et al. | 102/439 |
| 5,399,187 | 3/1995 | Mravic et al. | 75/228 |

FOREIGN PATENT DOCUMENTS

| | | | |
|---|---|---|---|
| 40875 | 10/1887 | Germany | 102/501 |
| 1133280 | 7/1962 | Germany | 102/501 |
| 1678 | 7/1855 | United Kingdom | 102/517 |

*Primary Examiner*—Harold J. Tudor
*Attorney, Agent, or Firm*—Paul E. Hodges, P.C.

[57] ABSTRACT

An ammunition projectile of enhanced flight characteristics, having a boat tail portion and including a circular land provided on the rear surface of the boat tail portion and concentric with the longitudinal centerline of the projectile, the land having a circular concave wall extending from the flat rear face of the boat tail portion to a circular flat surface of the land. Among other things, the projectile exhibits a lesser rate of velocity deceleration along its flight path to a target than like projectiles that do not include the land.

9 Claims, 1 Drawing Sheet

AMMUNITION PROJECTILE HAVING ENHANCED FLIGHT CHARACTERISTICS

FIELD OF INVENTION

This invention relates to ammunition projectiles, and particularly to a projectile adapted to be fired from a rifle.

BACKGROUND OF INVENTION

It is well known in the industry that a projectile fired from a weapon encounters a "wall" of relatively static air as the projectile exits the muzzle of the weapon. The projectile continually is forced to penetrate this static air as it proceeds along its flight path. This "wall" of static air tends to retard the flight of the projectile. Tapering of the leading end of the projectile has been shown to enhance the ability of the projectile to move forward through the static air. As a projectile moves through air, the flow lines of the air along the length of the projectile develop a vacuum adjacent the flat rear end of the projectile. This vacuum is generally conical in geometry and is a material factor in the rate at which the velocity of the projectile decreases as the projectile progresses along its flight path. Tapering of the trailing end of the projectile, i.e. developing a boat tail end on the projectile, has been shown to reduce somewhat the adverse effect of this vacuum upon the flight of the projectile. Further, it has been proposed in the prior art to add a conical solid section on the rear end of the projectile in an attempt to reduce the vacuum at this location. The apex of this conical section faces rearwardly of the projectile and will be recognized as detracting from the desired perpendicularity of the rear end of the projectile that provides a flat surface against which the expanding gases from the burning powder can act to propel the projectile from the weapon.

SUMMARY OF THE INVENTION

The present inventor has discovered that enhancement of several factors associated with the flight of a projectile fired from a weapon can be achieved by providing on the face of the trailing end of an elongated projectile a circular flat land which includes an outer circular wall that is substantially concave, between the rear face of the projectile and the distal flat surface of the land. Whereas this discovery arose quite by accident, the inventor has noted that this land appears to serve somewhat in the nature of a stationary rudder that tends to guide the projectile along a true flight path from the weapon to a target. The presence of the land as described herein has been noted to reduce the extent of "wobble" (yaw) of the projectile over the course of its flight path to a target. It has been further found that a projectile having this rear land with its arcuate wall decreases the rate at which the projectile loses its velocity over the course of its flight path to a target.

DETAILED DESCRIPTION OF INVENTION

Figure 1:
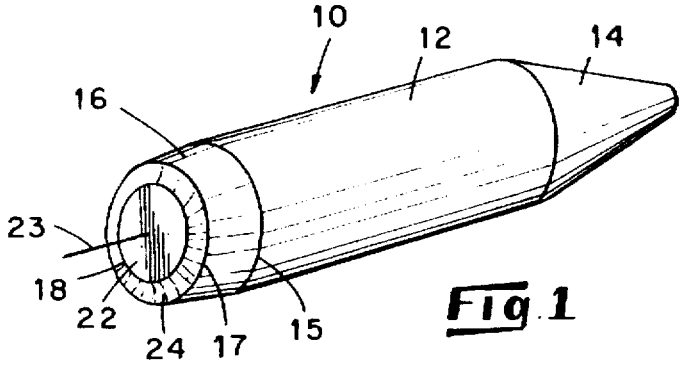
FIG. 1 is a perspective representation of a projectile having a circular flat land projecting from the rear surface of the trailing end of the projectile in accordance with the present invention.

Referring to the several Figures, there is depicted one embodiment of a projectile 10 having a cylindrical body portion 12, a tapered leading end 14, a rear end 15, a boat tail portion 16 which extends rearwardly from the rear end of the body portion 12 and terminates in a flat rear end surface 17, and a circular land 18 which projects rearwardly from the flat rear end surface 17 of the boat tail portion of the projectile. The land 18 includes a flat circular distal surface 22 that is essentially concentric of the longitudinal centerline 23 of the projectile and oriented substantially normal to the longitudinal centerline of the projectile. In accordance with one aspect of the present invention the area of transition from the flat rear end surface 17 of the boat tail portion to the flat distal surface 22 of the land 18 comprises an outer circular wall 24 that is substantially concave as viewed in a side plan view.

Figure 2:
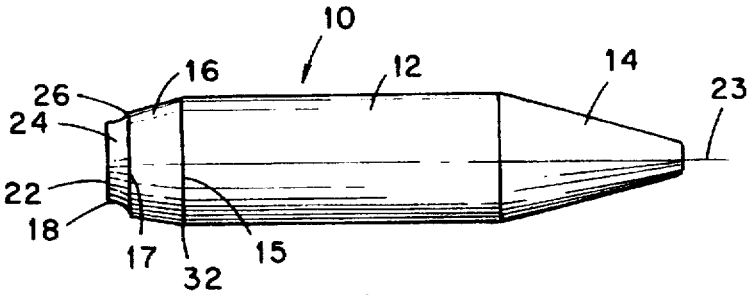
FIG. 2 is a plan side view, in section, of a projectile incorporating various of the features of the present invention.
Figure 3:
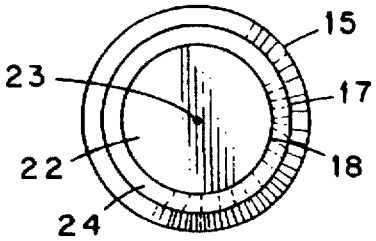
FIG. 3 is a trailing end view of the projectile of FIG. 2.
Figure 4:
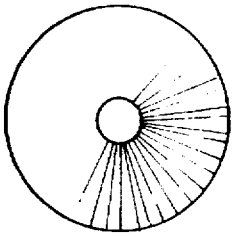
FIG. 4 is a leading end view of the projectile of FIG. 2.
Figure 5:
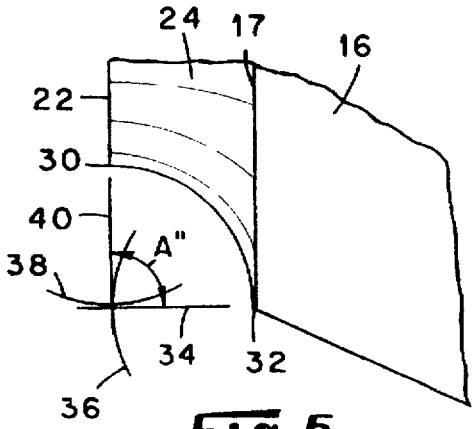
FIG. 5 is an enlarged view of a portion of the projectile of FIG. 2 taken generally along the line 5—5 of FIG. 2 and depicting the concavity of the outer wall of the land of the present invention; and, FIG. 6 is an enlarged view of the trailing end portion of the projectile of FIG. 2 and depicting relative dimensions of one embodiment of the projectile of the present invention.
Figure 6:
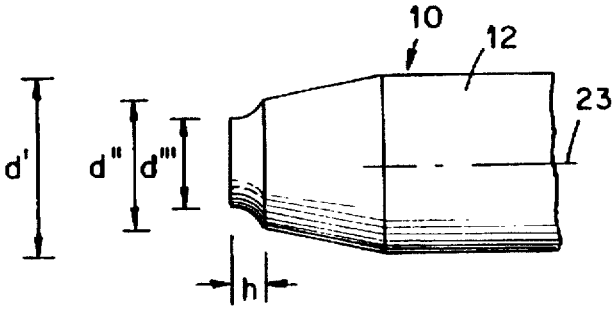

With particular reference to FIGS. 2, 5 and 6, in a preferred embodiment of the projectile of the present invention, the body portion 12 of the projectile exhibits a constant diameter, d', along at least a substantial portion of its length. The tapered boat tail tapers inwardly from the diameter d' of the body portion to a diameter d", whereupon the concave wall 24 of the circular land 18 commences and continues along its arcuate dimension to terminate at a diameter d'". This diameter d'" therefore becomes the diameter of the distal flat surface of the circular land 18. In a preferred embodiment, the area of the distal flat surface of the circular land is at least about 60% of the area of the rear end 15 of the tapered boat tail portion of the projectile, and preferably between about 60% and about 90% of the area of the rear end 15 of the boat tail 16. Land areas of less than about 60% of the area of the rear face of the boat tail tend to locate the rear rim 30 of the land too far radially inwardly toward the longitudinal centerline of the projectile to be effective in advantageously altering the flow of air past the rear end of the projectile. Similarly, land areas of greater than about 90% of the area of the rear face of the boat tail do not appear to materially enhance the performance of the projectile by reason of the presence of the land.

The height, h, of the land (see FIG. 5) is principally a function of the difference in the circumferences of the rim 32 of the rear end of the boat tail and the rear rim 30 of the land (assuming the radius of curvature of the wall 24 is constant). Desirably, the height of the land is maintained at a minimum value, consistent with the ability of the land to effect the desired enhancement of the flight of the projectile. By way of example, an 87 grain, 0.223 caliber projectile tapered to a diameter of 0.18 inch (area of 0.05 $inch^2$) by a boat tail and having a land of a height of 0.020 inch and an area of about 0.018 inch has been found to be satisfactory to provide the projectile with the enhanced flight characteristics attributable to the present invention.

Movement of a projectile through air develops shock waves that tend to spread outwardly from the projectile, i.e. at an angle to the flight path of the projectile. At the rear end of the projectile, the displacement of air away from the projectile creates a vacuum adjacent the rear end of the projectile. This vacuum creates a drag upon the projectile. Whereas it is not known with certainty exactly why a land as disclosed herein provides the flight enhancement features which have been noted by the present inventor, it is believed that the land, with its concave circular wall 24, alters the flow of the air across the outer surface of the projectile during its flight, possibly by reason of the formation of eddy currents in the region of the transition from the trailing end 17 of the boat tail portion to the flat distal surface 22 of the land, which eddy currents tend to maintain the rear end of the projectile concentric with the longitudinal centerline of the projectile. It is further felt that the curvature of the circular wall 24 of the land in some manner reduces the degree of vacuum produced adjacent the rear end of the projectile as it moves along its flight path, perhaps by creating a "side" vacuum which tends to draw the shock waves radially inwardly toward the concave wall such that the shock waves are more readily and sharply drawn radially inwardly toward the longitudinal centerline of the projectile at the rear rim 30 of the land. It has been further suggested that the effect of the concave wall of the land serves to decrease the overall spreading angle of the shock waves created by the moving projectile by reason of the addition of the further circular rim 30 at the rear end of the projectile which acts in concert with the rim 32 at the rear end of the boat tail and the forward edge of the land. It has been noted that a straight or convex wall on the land provides no benefit with respect to the performance of the projectile, so that for whatever reason, the presence of the concave wall of the land provides the noted enhancement of the performance of the projectile having the land thereon. Further, it has been noted by the present inventor that the presence of the land with its concave circular wall reduces the rate of deceleration of the projectile along its flight path, resulting in the projectile having a flatter trajectory and striking the target at a greater velocity than is observed for the same projectile which does not include a land as disclosed herein, the two projectiles being fired under like conditions. This reduction of drag upon the projectile during its free flight to a target translates into reduced wind drift of the projectiles and an enhanced minute of angle (MOA).

In accordance with the present invention, the radius of curvature of the concave wall 24 of the land 18 is a function of the height of the land. More specifically, the radius of curvature, as viewed in FIG. 5, of the circular concave wall 24 of the land is preferably equal to the height of the land, so that the arcuate length (height) of the wall is subtended by an angle "A" of 90 degrees or less that is formed by a line 34 drawn from the rear rim 32 of the boat tail to the intersection of an arc 36 scribed a distance from the rear rim 32 of the boat tail that is equal to the height of the land and an arc 38 scribed an equal distance from the rear rim 30 of the land, and a line 40 drawn from the rear rim 30 of the land, all as viewed in FIG. 5. At angles of greater than 90 degrees, the angle developed at the junction of the wall, with either the rear end of the boat tail and/or with the distal face of the land fails to develop the desired sharp circular edge produced at each of the rim 30 and the rim 32, which affects the desired flow of air past the projectile while in flight. It will be recognized that the concavity of the wall 24 can be somewhat nonuniform in cross-section, but at the risk of losing some of the benefits of the present invention.

In a specific example of one embodiment of a projectile as contemplated by the present invention, a projectile having a body portion diameter, d', of 0.223 inch was provided with a boat tail section that tapered inwardly from the outer circumference of the body portion to a diameter, d", of about 0.18 inch. The area of the rear flat surface of the boat tail portion, therefore, was about 0.025 inch$^2$. A land having a concave side wall 24 which commenced at the circumferential rear end 26 of the flat surface 17 of the boat tail portion was provided on the projectile. This land extended to a height, h, of about 0.020 inch from the flat surface 17 of the boat tail portion, and exhibited a diameter, d'", of about 0.18 inch, thereby providing an area of about 0.018 inch$^2$ for the distal flat surface 22 of the land. This distal flat surface was oriented normal to the longitudinal centerline 23 of the projectile. The projectile was formed from a mixture of about 60% by weight of tungsten powder and about 40% by weight of lead powder, plus about 0.10% by weight of a polyethylene powder, that was cold-compacted into a core that was subsequently encased in a copper metal jacket. This jacket/core subassembly was thereafter die-formed to develop the boat tail portion and the circular land.

Projectiles made up in accordance with the above example were test fired from a rifle, employing a bench rest, to targets at ranges of 100 yards, 200 yards and 1000 yards. Identical projectiles, without the land, were fired from the same rifle to targets at the same ranges. Each firing consisted of five rounds fired at each range. At all ranges, the patterns developed by the projectiles having a land thereon in accordance with the present invention were tighter, on the average, by about 30%, than the patterns developed by the projectiles which did not include a land as disclosed herein. This enhancement in accuracy of delivery of the landbearing projectiles is a function of the flight stabilization produced by the land on the projectiles of the present invention.

Chronographic data taken at the muzzle of the weapon and adjacent the target for fired projectiles in accordance with the present invention and like projectiles without a circular land show that the projectiles of the present invention exhibited less decleration along their flight path than like projectiles that did not include a land as disclosed herein.

What is claimed:

1. An ammunition projectile having enhanced flight characteristics comprising a cylindrical body portion having a longitudinal centerline, a leading end, and a rear end, a boattail portion including a non-radiussed sharp circumferential edge defining a non-radiussed sharp juncture between said rear end of said body portion of the projectile and said boattail portion, and a truncated frusto-conical wall which tapers from said non-radiussed sharp circumferential edge gradually inwardly toward the longitudinal centerline of the projectile to terminate in a flat rear end surface having a non-radiussed outer sharp circumferential edge, a circular land defined on the rear end of said boattail portion and extending rearward therefrom to define a flat circular surface distally of said land, and a continuous concave arcuate wall connecting said flat rear end surface of said trailing end of said boattail portion to said flat circular surface of said land, the continuous concave arcuate wall of said land subtends an angle of 90 degrees or less, and the area of said flat circular surface of said land being between about 60% and about 90% of the area of the flat rear end surface of said boattail portion whereby said projectile exhibits a lesser rate of velocity deceleration during flight to a target than a like projectile without a land and its accompanying concave arcuate wall fired under like circumstances.

2. The projectile of claim 1 wherein the concave arcuate wall of said land is of substantially uniform curvature in cross section.

3. The projectile of claim 1 wherein said land includes a circular rim at its rear end, and said angle is formed at the intersection of an imaginary line drawn from the non-radiussed outer sharp circumferential edge at the rear end of the boattail portion and an imaginary line drawn from the circular rim of the rear end of the land, said imaginary lines being of equal length, as viewed in a side plan view of the projectile.

4. The projectile of claim 1 wherein said circular land is substantially concentric with said longitudinal centerline of said projectile and oriented substantially normal to said longitudinal centerline.

5. The projectile of claim 1 wherein the radius of curvature of said concave arcuate wall is equal to the height of said land.

6. A method for the manufacture of an ammunition projectile having enhanced flight characteristics comprising the steps of forming a cylindrical body portion of the projectile, said body portion having a longitudinal centerline and a trailing rear end, terminating said trailing rear end of the projectile in a non-radiussed sharp outer circumferential edge of said body portion, forming a boattail portion which projects rearwardly of said body portion of the projectile from said non-radiussed sharp outer circumferential edge of said body portion and defines a non-radiussed sharp juncture between said rear end of the projectile and said boattail portion, said boattail portion including a truncated frusto-conical wall which tapers from said non-radiussed juncture gradually inwardly toward the longitudinal centerline of the projectile to terminate in a flat rear end surface having an outer sharp circumferential edge, providing a circular land on said flat rear end surface of said boattail portion, said circular land extending rearwardly from said flat rear end surface of said boattail portion and terminating in a flat circular surface having an outer sharp circumferential edge, interconnecting said outer circular edge of said flat circular surface of said land to said outer circular edge of said flat rear end surface of said boattail portion by a continuous concave arcuate wall which subtends an angle of 90 degrees or less, and the area of said flat circular surface of said land being between about 60% and about 90% of the area of the flat rear end surface of said boattail portion.

7. The method of claim 6 wherein the projectile includes a longitudinal centerline and the circular land is formed concentrically of and with its flat circular substantially normal to the longitudinal centerline of the projectile.

8. The method of claim 6 wherein said concave arcuate wall is of substantially uniform curvature.

9. The method of claim 6 wherein said angle is formed at the intersection of an imaginary line drawn from said outer sharp circumferential edge of said flat circular surface of said land and an imaginary line drawn from said outer sharp circumferential edge of said flat rear end surface of said boattail portion, said imaginary lines being of equal length, as viewed in a side plan view of the projectile.

* * * * *